US005553663A

United States Patent [19]

Yu

[11] Patent Number: 5,553,663

[45] Date of Patent: Sep. 10, 1996

[54] HEAT EXCHANGE FOR AIR CONDITIONER

[75] Inventor: Si-Hong Yu, Seoul, Rep. of Korea

[73] Assignee: Samsung Electronics Co., Ltd., Suwon, Rep. of Korea

[21] Appl. No.: 504,369

[22] Filed: Jul. 19, 1995

[30] Foreign Application Priority Data

Jul. 21, 1994 [KR] Rep. of Korea ..... 94-17699

[51] Int. Cl.[6] ..... F28D 1/04; F28F 1/32

[52] U.S. Cl. ..... 165/151; 165/DIG. 502; 165/DIG. 503

[58] Field of Search ..... 165/151, 182, 165/DIG. 502, DIG. 503

[56] References Cited

U.S. PATENT DOCUMENTS

| | | | |
|---|---|---|---|
| 5,099,914 | 3/1992 | Reifel | 165/151 |
| 5,360,060 | 12/1992 | Tanaka et al. | 165/151 |

FOREIGN PATENT DOCUMENTS

| | | | |
|---|---|---|---|
| 61-191893 | 8/1986 | Japan | 165/151 |
| 61-259092 | 11/1986 | Japan | 165/151 |
| 63-38892 | 2/1988 | Japan | 165/151 |
| 63-150589 | 6/1988 | Japan | 165/151 |
| 4-15493 | 1/1992 | Japan | 165/151 |

*Primary Examiner*—Allen J. Flanigan

*Attorney, Agent, or Firm*—Burns, Doane, Swecker & Mathis, L.L.P.

[57] ABSTRACT

A heat exchanger for an air conditioner comprises parallel fins through which air flows. A pipe system is disposed in the air flow and conducts a fluid which exchanges heat with the air flow. The pipe system includes a plurality of pipe segments extending between adjacent ones of the fins. Each fin includes a row of flow disrupting elements disposed adjacent a respective pipe segment such that an upstream end of each row is situated forwardly of an upstream side of the respective pipe segment, and a downstream end of each row is situated rearwardly of a downstream side of the respective pipe segment. Situated in the row is a flow diverting member which transfers air flow from one side of the fin to the other.

9 Claims, 4 Drawing Sheets

HEAT EXCHANGE FOR AIR CONDITIONER

BACKGROUND OF THE INVENTION

1. Field of the Invention

The present invention relates in general to a heat exchanger for an air conditioner.

2. Description of the Prior Art

With reference to FIG. 1, there is shown the construction of a conventional heat exchanger for an air conditioner. As shown in the above drawing, the conventional heat exchanger includes a plurality of regularly spaced flat fins 100. The fins 100 are vertically arranged such that they parallel each other. A plurality of heat transfer pipes 102 are angularly fitted into the fins 100 such that the pipes 102 are perpendicular to the fins 100. The air currents flow in the space defined between the fins 100 in the direction of the arrow A in FIG. 1 and exchanges heat with the fluid flowing in the heat transfer pipes 102.

A thermal fluid flowing around each flat fin 100 is characterized in that the thickness of the thermal boundary layer 103 on both heat transfer surfaces of the fin 100 is gradually thickened in proportion to square root of the distance from the air current inlet end of the fin 100 as shown in FIG. 2. In this regard, the heat transfer rate of the fin 100 is remarkably reduced in proportion to the distance from the air current inlet end. Therefore, the above heat exchanger has a lower heat transfer efficiency.

When lower velocity air currents flow in the direction of the arrow of FIG. 3, the thermal fluid flowing about each heat transfer pipe 102 is characterized in that the air currents separate from the outer surface of the pipe 102 at portions spaced apart from the stagnation point of the pipe 102 at angles of 70°–80° . Therefore, a cavitation zone 104 is formed in the back of the pipe 102 as shown in the region of FIG. 3 designated by cross hatching. In the cavitation zone 104, the heat transfer rate of the pipe 102 is remarkably reduced so that the heat transfer efficiency of the above heat exchanger becomes worse.

In order to overcome the above problems, Japanese U.M. Laid-open Publication No. Sho. 55-110995 proposes an improved heat exchanger for air conditioners. As shown in FIGS. 4 and 5, the Japanese heat exchanger includes a plurality of heat transfer pipes 112 which are fitted into the regularly spaced flat fins 110 (only one fin depicted) such that the pipes 112 are perpendicular to the fins 110. The above heat exchanger also includes a plurality of slit type grilles which are formed beside the pipes 112 on each fin 110. Each slit type grille is formed by vertically slitting a given portion of the fin 110 several times and alternately bending the remaining strips in opposite directions, thereby forming a plurality bent strips 115*a*, 115*b*, 115*c*, 115*d*, 115*e* and 115*f* in the fin 110.

That is, three strips 115*a*, 115*c* and 115*e* are bent to one side of the fin 110 such that the strips 115*a*, 115*b* and 115*c* are regularly spaced apart from each other. However, the other three strips 115*b*, 115*d* and 115*f* placed between the above strips 115*a*, 115*c* and 115*e* are bent to the other side of the fin 110.

The above-described heat exchanger having the plurality of slit type grilles on each flat fin 110 causes the heat exchanging fluid flow to become turbulent due to the above grilles, thereby reducing the thickness of the thermal boundary layers formed on the fins 110. The pressure of thin thermal boundary layers somewhat improves the heat transfer efficiency in comparison with the conventional heat exchanger having the flat fins 110 with no slit type grilles. When the partial heat transfer capacities of the heat exchanger are measured, the upstream strips 115*a* and 115*b* form the thin thermal boundary layers, thus improving the heat transfer efficiency. However, as the downstream strips 115*c* to 115*f* are included in the thermal boundary layers formed by the upstream strips 115*a* and 115*b*, the downstream strips 115*c* to 115*f* can not improve the heat transfer efficiency. In addition, the cavitation zone is still formed in the back of each heat transfer pipe 112. Furthermore, the air currents flowing in the space defined between the flat fins 110 are laminar and do not become mixed together. Therefore, the above Japanese heat exchanger is not expected to provide the improved heat transfer efficiency as could occur if the air currents are mixed together.

SUMMARY OF THE INVENTION

It is, therefore, an object of the present invention to provide a heat exchanger for air conditioners in which the above problems can be overcome and which mixes the turbulent flows on the flat fins together and improves the heat transfer efficiency and effectively reduces the cavitation zone formed in the back of each heat transfer pipe.

In order to accomplish the above object, a preferred embodiment of the present invention provides a heat exchanger for air conditioners comprising a plurality of regularly spaced flat fins parallel to each other for letting the air currents flow in the space defined between the fins, and a plurality of heat transfer pipes fitted into the fins and perpendicular to the fins and zigzagged when viewing the pipes from one side of the fin, wherein the improvement comprises: a plurality of slit type grilles for causing the air currents on the both sides of each fin to become turbulent flows at the heat transfer pipes and thereby improving the heat transfer efficiency of the heat exchanger, each slit type grille being formed in the fin between the heat transfer pipes in the direction of the air flow; and a plurality of louver type grilles for mixing together the turbulent flows, formed by the slit type grilles, and thereby reducing cavitation zones formed in the back of the pipes, each louver type grille being angularly formed in the center of each slit type grille in the direction of the air flow.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF A PREFERRED EMBODIMENT

Figure 1:
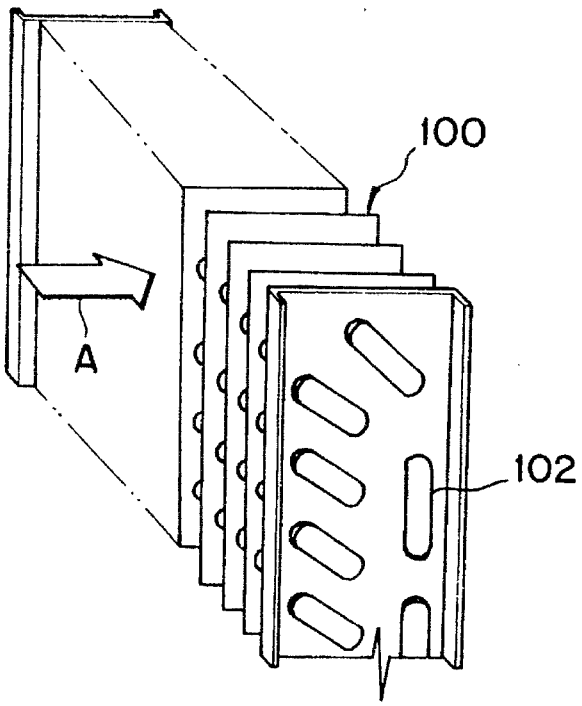
FIG 1 (PRIOR ART)
FIG. 1 is a perspective view showing the construction of a conventional heat exchanger for air conditioners.
Figure 2:
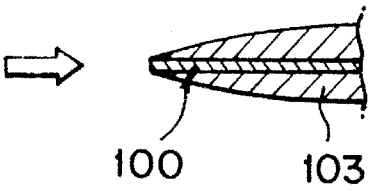
FIG 2 (PRIOR ART)
FIG. 2 is an enlarged sectional view of a flat fin of the heat exchanger of FIG. 1, showing the characteristic of the thermal fluid flowing about the fin.
Figure 3:
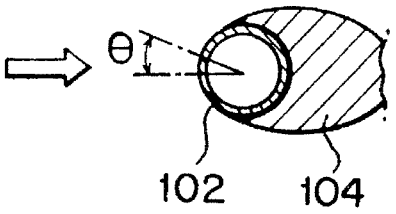
FIG 3 (PRIOR ART)
FIG. 3 is an enlarged sectional view of a heat transfer pipe of the heat exchanger of FIG. 1, showing the characteristic of the thermal fluid flowing about the heat transfer pipe.
Figure 4:
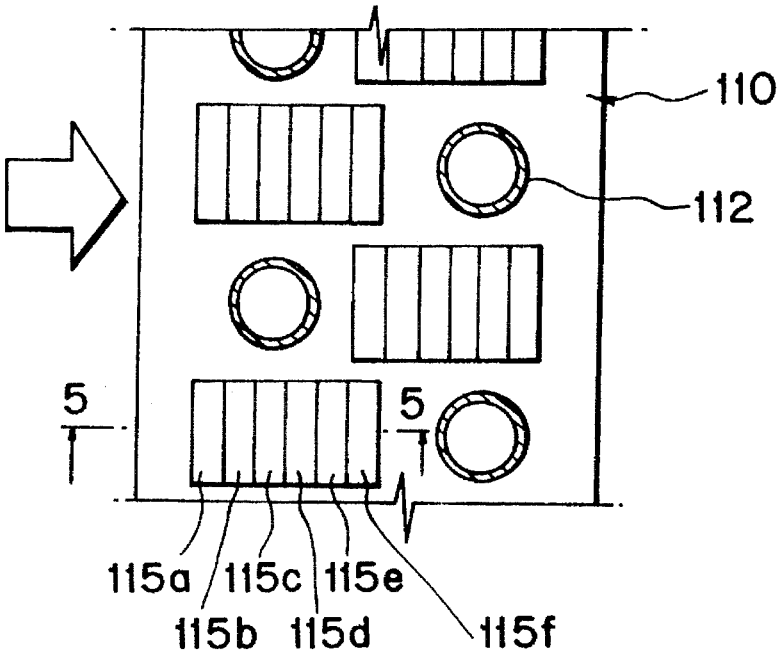
FIG 4 (PRIOR ART)
FIG. 4 is a front view of a flat fin having a plurality of slit type grilles in accordance with another prior art heat exchanger.
Figure 5:
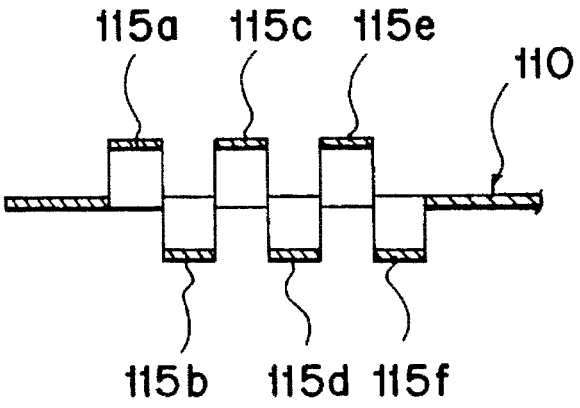
FIG 5 (PRIOR ART)
FIG. 5 is a sectional view of one slit type grille of the flat fin taken along the section line 5—5 of FIG. 4.
Figure 6:
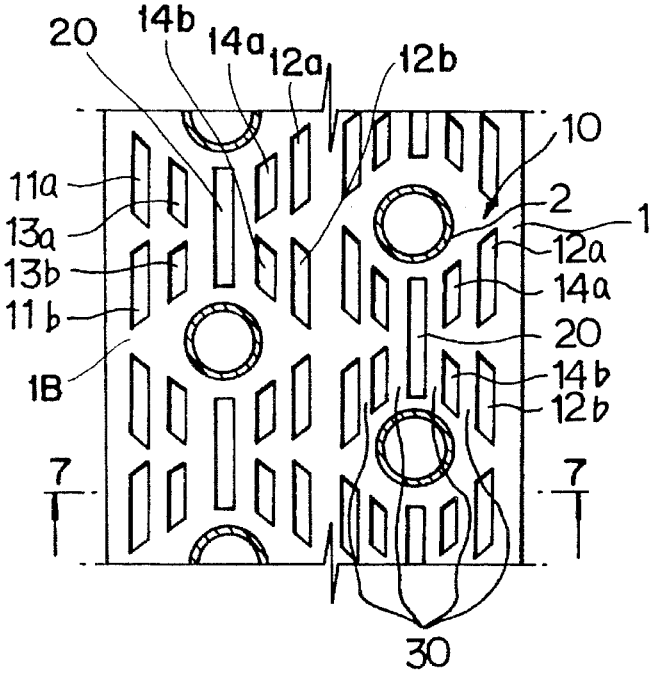
FIG. 6 is a front view of a flat fin of a heat exchanger for air conditioners in accordance with a preferred embodiment of the present invention.

With reference to the drawings, FIG. 6 is a front view of a flat fin of a heat exchanger for air conditioners in accordance with a preferred embodiment of the present invention.

Figure 9:
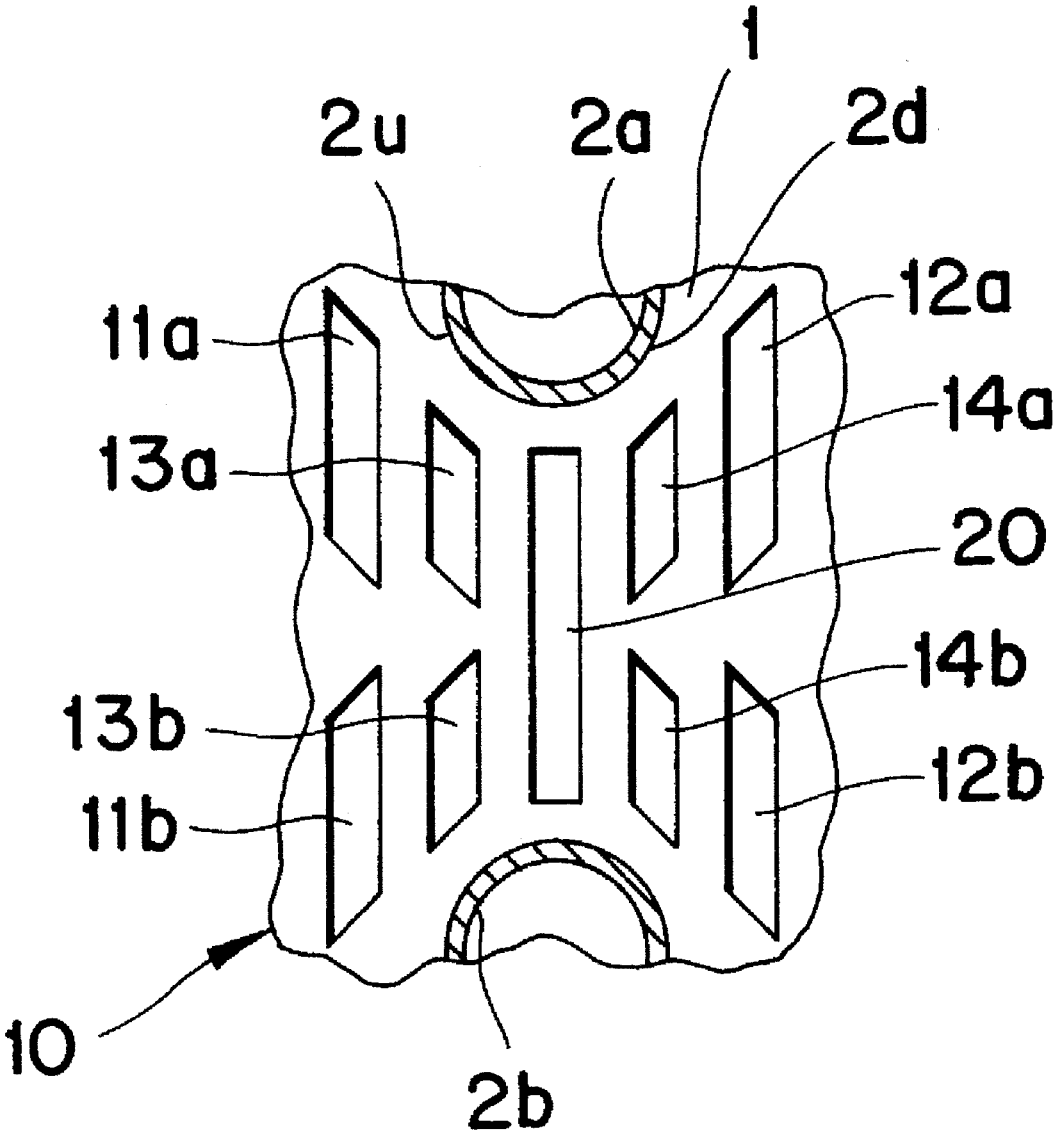
FIG. 9 is a fragmentary view of the flat fin, depicting one slit-type grille.

As shown in FIG. 6, the heat exchanger of this invention includes a plurality of flat fins 1 which are regularly spaced apart from each other and parallel to each other, thus letting the air currents flow in the channel or space defined between them. A plurality of heat transfer pipes 2 (i.e., segments of a pipe system) are fitted into the fins 1 such that the pipes 2 are perpendicular to the fins 1 and form a ZIG-ZAG pattern when viewed from the one side of fin 1 (see FIG. 7). In order to let the air currents on both sides of each fin 1 become turbulent at the heat transfer pipes 2, thereby improving the heat transfer efficiency of the heat exchanger, each flat fin 1 is provided with a plurality of slit type grilles 10. Each slit type grille 10 shown in FIG. 9, is formed in the fin 1 between vertically adjacent segments of the heat transfer pipe system in the direction of the air flow. The slit type grille 10 includes a row of strips or air flow disrupting elements; which are formed by vertically slitting a given portion of the fin 1 and bending the strips to opposite sides of the fin 1. Thus, each strip constitutes a partially cut-out and bent portion of a fin. In this case, the strips are regularly spaced apart from each other. Each flat fin 1 also includes a plurality of louver type grilles or air diverting members 20 for mixing together the turbulent flows, formed by the slit type grilles 10, and effectively reducing the cavitation zones formed in the back of the pipes 2. Each louver type grille 20 is angularly formed in the center of each slit type grille 10 in the direction of the air flow and is situated in a through-hole 20A formed in the fin.

In this case, the strips of each slit type grille 10 and an associated louver type grille 20 are alternately bent to the opposite sides of the fin 1 with bases 30 remaining between the strips and the louver type grille 20.

That is, with reference to FIG. 9 each slit type grille 10 includes first and second strips 11*a* and 11*b*arranged one above the other. The strips 11*a* and 11*b* are vertically formed in each fin 1 in front of the pipe 2, with a base 30 formed between the two strips 11*a* and 11*b*. The two strips 11*a* and 11*b* are vertically symmetric to each other. The first and second strips 11*a* and 11*b* cause the air currents to become turbulent when the air currents pass by the fin 1 in front of the pipes 2. Third and fourth strips 12*a* and 12*b* are vertically formed in each fin 1 behind the pipe 2, with the base 30 formed between the strips 11*a* and 11*b* and the strips 12*a* and 12*b*. The strips 12*a* and 12*b* are symmetric to the strips 11*a* and 11*b*. The third and fourth strips 12*a* and 12*b* cause the air currents to become turbulent when the air currents pass by the fin 1 behind the pipes 2. Each slit type grille 10 also includes fifth and sixth strips 13*a* and 13*b*arranged one above the other the strips 13*a* and 13*b* are vertically formed in the fin 1 behind the first and second strips 11*a* and with the base 30 formed between the strips 11*a* and 11*b* and the strips 13*a* and 13*b*. The two strips 13*a* and 13*b* are vertically symmetric to each other with the base 30 therebetween. The fifth and sixth strips 13*a* and 13*b* cause the air currents to become turbulent when the air currents pass by the fin 1 in front of the pipes 2. Seventh and eighth strips 14*a* and 14*b* are vertically formed one above the other in the fin 1 behind the pipe 2, with the base 30 formed between the strips 13*a* and 13*b* and the strips 14*a* and 14*b*. The strips 14*a* and 14*b* are symmetric to the strips 13*a* and 13*b*. The seventh and eighth strips 14*a* and 14*b* cause the air currents to become turbulent when the air currents pass by the fin 1 behind the pipes 2.

Figure 7:
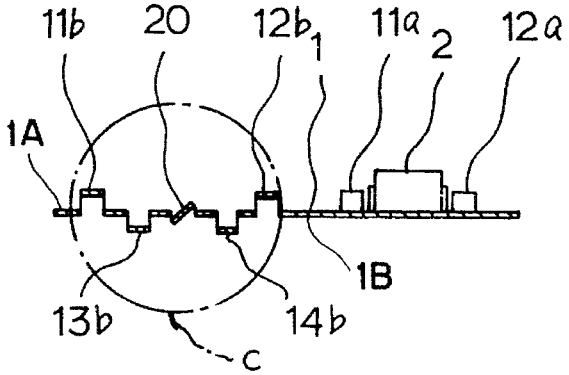
FIG. 7 is a sectional view of the flat fin taken along the section line 7—7 of FIG. 6.
Figure 8:
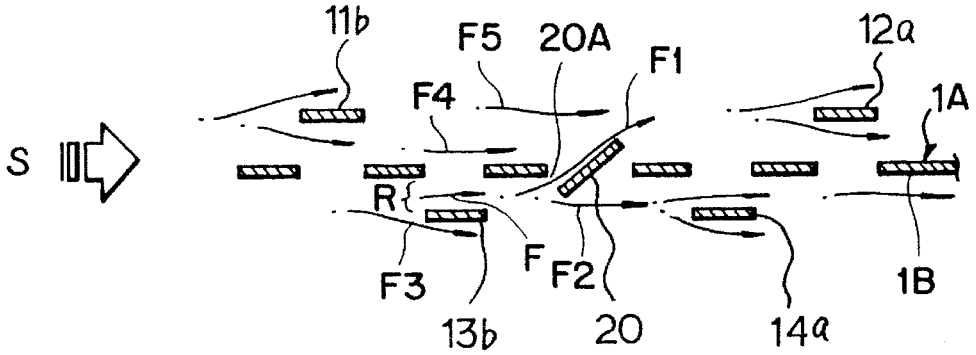
FIG. 8 is an enlarged view of the portion C of FIG. 7, showing the air currents flowing about the grilles of the fin.

In the above-described strips, the first to fourth strips 11*a*, 11*b*, 12*a* and 12*b* open to the direction of the air flow and are bent to a first side 1A of the fin 1 as shown in FIGS. 7 and 8. The fifth to eighth strips 13*a*, 13*b*, 14*a* and 14*b* open to the direction of the air flow and are bent to a second side 1B of the fin 1.

The louver type grille 20 is formed in the fin 1 between the pair of strips 13*a* and 13*b* and the pair of strips 14*a* and 14*b* with the base 30 formed between them. The louver type grille 20 opens in the direction of the air flow.

That is, the louver type grille 20 is formed in the fin 1 such that a first side of the grille 20 in the drawing projects to the first side 1A of the fin 1, while a second side of the part 20 projects to the second side 1B of the fin 1.

The vertical length of each louver type grille 20 is shorter than that of an associated slit type grille 10. That is, either of (i) either the vertical length from the top end of the first strip 11*a* to the bottom end of the second strip 11*b*, and (ii) the vertical length from the top end of the third strip 12*a* to the bottom end of the fourth strip 12*b*, is longer than the vertical length of the louver type grille 20. In addition, either of (i) the vertical length from the top end of the fifth strip 13*a* to the bottom end of the sixth strip 13*b*, and (ii) the vertical length from the top end of the seventh strip 14*a* to the bottom end of the eighth strip 14*b*, is longer than the vertical length of the louver type grille 20, but shorter than either of (i) the vertical length from the top end of the first strip 11*a* to the bottom end of the second strip 11*b* and (ii) the vertical length from the top end of the third strip 12*a* to the bottom end of the fifth strip 12*b*. It will be appreciated from the foregoing that there is a row of air flow disrupting elements 11*a*, 13*a*, 14*a*, and 12*a* arranged adjacent a pipe segment 2*a* (see FIG. 9). An upstream end of that row defined by element 11*a* is disposed forwardly of the pipe segment 2*a*, and a downstream end of the row (defined by element 12*a*) is disposed rearwardly of the pipe segment 2*a*. The element 1*a* extends upwardly into the path of air flow traveling toward an upstream side of the pipe segment 2*a*, and the element 12*a* extends upwardly into the path of air flow traveling away from a downstream side of the pipe segment 2*a*. The air diverting member 20 is disposed in that row of elements at a location intermediate upstream and downstream ends thereof. Thus, there are air flow disrupting elements 13*a* and 14*a* disposed upstream and downstream, respectively, of the flow diverting member on one side of the fin, and air flow disrupting elements 11*a*, 12*a* disposed upstream and downstream, respectively, of the flow diverting member on the other side of the fin. The air diverting member 20 is disposed intermediate upstream and downstream sides 2*u*, 2*d* of the pipe segment 2*a*.

The operation of the above heat exchanger will be described hereinafter.

When the air currents flow in the direction of the arrow S of FIG. 8, through the space defined between the flat fins 1 and past the strips 11*a*, 11*b*, 12*a*, 12*b*, 13*a*, 13*b*, 14*a* and 14*b* of each of the grilles 10, the air becomes turbulent to improve the heat transfer efficiency at the opposite sides of the fins 1. When the air currents pass by each slit type grill 10, the air currents also pass by the louver type grille 20 formed between the strips 13*a* and 13*b* and the strips 14*a* and 14*b*, thus being separated into two flows which will be mixed together later. The louver type grilles 20 thus reduce the cavitation zones formed at the back of the heat transfer pipes 2.

That is, since the strips 11*a*, 11*b*, 12*a* and 12*b* are bent to a side 1A of the fin 1 opposite the side 1B to which the 13*a*, 13*b*, 14*a* and 14*b* are bent, the strips 11*a*, 11*b*, 12*a* and 12*b* are not included in the thermal boundary layers formed by the strips 13*a*, 13*b*, 14*a* and 14*b* in the direction of the air flow. Therefore, the heat transfer efficiency of the heat exchanger is improved.

In addition, the strips 11*a*, 11*b*, 12*a*, 12*b*, 13*a*, 13*b*, 14*a* and 14*b* of each slit type grille 10 are arranged about a respective pipe 2 such that the strips surround the pipe 2 and form a generally X-shaped arrangement as shown in FIG. 6 and 9. Therefore, the air currents flowing on the opposite surfaces of the fins 1 rapidly become turbulent at the top and bottom ends of the strips 11*a*, 11*b*, 12*a*, 12*b*, 13*a*, 13*b*, 14*a* and 14*b* while flowing about the pipes 2, thus reducing the cavitation zones 4 formed at the back of the pipes 2 and improving the heat transfer efficiency at the back of the pipes 2.

The louver type grille 20 is formed in the fin 1 between the pair of strips 13*a* and 13*b* and the pair of strips 14*a* and 14*b* such that the left side of the grille 20 in FIG. 7 projects to the side 1B of the fin 1. The right side of the grille 20 projects to the side 1A of the fin 1. Therefore, the turbulent flow F passing through the space disposed between the side 1B of the fin 1 and the strips 13*a* and 13*b* is separated by the louver grille 20 into two flows F1, F2 which will flow on the opposite sides of the fin 1 as shown in FIG. 8.

The turbulent flow F2 forced to the side 1B of the fin 1 by the louver type grille 20 is mixed with a turbulent flow F3, which has passed by the strips 13*a* and 13*b*. The mixed flow F2, F3 in turn flows to the strips 14*a* and 14*b*. At the same time, the air currents also become turbulent at the top and bottom ends of the louver type grille 20 and flow about the pipes 2, thus to remarkably reduce the cavitation zones formed in the back of the pipes 2 on the side 1B of each fin 1. Therefore, the heat transfer efficiency in the back of the pipes 2 is improved.

The turbulent flow F1 forced to the side 1A of the fin 1 by the louver type grille 20 is mixed with the turbulent flows F4, F5 flowing by the opposite surfaces of the strips 11*a* and 11*b* and in turn flows to the strips 12*a* and 12*b*. At the same time, the air currents also become turbulent at the top and bottom ends of the louver type grille 20 and flow about the pipes 2, thus to remarkably reduce the cavitation zones formed in the back of the pipes 2 on the side 1A of each fin 1. Therefore, the heat transfer efficiency in the back of the pipes 2 is improved.

As described above, the present invention provides a heat exchanger for air conditioners having a plurality of slit type grilles, each grille comprising a plurality of strips formed in the fin about each heat transfer pipe with bases formed between strips. The above strips are alternately bent to opposite sides of each fin. A louver type grille is formed in the center of each slit type grille. With the above slit type grilles and louver type grilles, the heat exchanger of this invention causes the air currents flowing on the opposite sides of the fin become turbulent, thus improving the heat transfer efficiency on the opposite sides of each fin. In addition, the louver type grilles mix the air currents together, thereby reducing the cavitation zone formed in the back of each heat transfer pipe and improving the heat transfer efficiency in the back of the pipes.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A heat exchanger for an air conditioner, comprising a plurality of regularly spaced fins arranged in parallel for forming an air flow channel between each adjacent pair of fins, the air flowing from a forward end to a rearward end of said channel, and a heat transfer pipe arrangement for conducting fluid that is to exchange heat with said air, said pipe arrangement including spaced apart parallel pipe segments extending through said fins across said channels, the improvement wherein each fin includes:

a row of air flow disrupting elements arranged one behind the other in the direction of air flow, each said element disposed outwardly of a respective side of its respective fin such that some of said elements are disposed adjacent a side of said fin opposite a side to which others of said elements are disposed, said row including an upstream end and a downstream end, said row being located adjacent a respective pipe segment such that said upstream end of said row is disposed forwardly of said pipe segment, and said downstream end of said row is located rearwardly of said pipe segment, said elements causing flowing air to become turbulent at locations forwardly and rearwardly of said pipe segment; and an air flow diverting member arranged in said row intermediate said upstream and downstream ends thereof such that there is a said element located forwardly and rearwardly thereof on each side of said fin, said member disposed in a through-hole formed in said fin and arranged to force some of the air flow from one side of said fin to the other side of said fin through said through-hole, said member arranged intermediate upstream and downstream sides of said pipe segment.

2. The heat exchanger according to claim 1, wherein each of said elements constitutes a partially cut-out and bent-out portion of said fin, and said diverting member constitutes a partially cut-out portion of said fin arranged at an oblique angle relative to said fin.

3. The heat exchanger according to claim 2, wherein said diverting member includes portions extending obliquely outwardly from respective sides of said fin.

4. The heat exchanger according to claim 1, wherein one of said elements is disposed forwardly of said pipe segment and extends into a path of travel of air traveling toward said upstream side of said pipe segment.

5. The heat exchanger according to claim 4, wherein one of said elements is disposed rearwardly of said pipe segment and extends into a path of travel of air traveling away from said downstream side of said pipe segment.

6. The heat exchanger according to claim 1, wherein said row of elements includes two elements disposed adjacent one side of said fin which are situated between two elements disposed on the other side of said fin.

7. The heat exchanger according to claim 1, wherein said pipe segment constitutes a first pipe segment, and further including a second pipe segment spaced from said first pipe segment, said row of air flow disrupting elements constituting a first row disposed in a space between said first and second pipe segments, there being a second row of air flow disrupting elements situated in said space and adjacent said second pipe segment, an upstream end of said second row being disposed forwardly of said second pipe segment, a downstream ed of said second row located rearwardly of said second pipe segment, said second row of elements causing flowing air to become turbulent at locations forwardly and rearwardly of said second pipe segment, said air flow diverting member extending into said second row and being arranged intermediate upstream and downstream sides of said second pipe segment.

8. The heat exchanger according to claim 7, wherein said pipe segments are arranged in a zig-zag pattern, each pair of pipe segments being spaced apart in a direction perpendicular to said direction of air travel and having said first and second rows disposed therebetween.

9. The heat exchanger according to claim 7, wherein said flow disrupting elements of said first row being aligned with corresponding flow disruptive elements of said second row.

* * * * *